US005475411A

United States Patent [19]

Strain et al.

[11] Patent Number: 5,475,411

[45] Date of Patent: Dec. 12, 1995

[54] METHOD OF FABRICATING A CATCHER/CHARGE PLATE ASSEMBLY

[75] Inventors: Gary L. Strain, Brookville; Brian G. Morris, Dayton, both of Ohio

[73] Assignee: Scitex Digital Printing, Inc., Dayton, Ohio

[21] Appl. No.: 891,328

[22] Filed: May 29, 1992

[51] Int. Cl.[6] ..... B41J 2/085; B41J 2/185

[52] U.S. Cl. ..... 347/90; 347/76

[58] Field of Search ..... 347/73, 74, 76, 347/77, 90

[56] References Cited

U.S. PATENT DOCUMENTS

| | | | |
|---|---|---|---|
| 4,010,477 | 3/1977 | Frey | 347/74 |
| 4,234,884 | 11/1980 | Vedder | 347/74 |
| 4,560,991 | 12/1985 | Braun et al. | 347/76 |
| 4,620,195 | 10/1986 | Eblen et al. | 347/76 X |
| 4,857,940 | 8/1989 | Rueping | 347/90 |
| 4,928,113 | 5/1990 | Howell et al. | 347/76 |

*Primary Examiner*—William J. Royer
*Attorney, Agent, or Firm*—Barbara Joan Haushalter

[57] ABSTRACT

A charge plate fabrication process provides a catcher/charge plate assembly having improved manufacturability. The fabrication process includes the steps of providing a catcher, including a catch pan, and providing a ceramic charge plate, the charge plate having an electrode face. The charge plate electrode face is prelapped to a uniform negative angle before assembling the charge plate and the catcher in a fixture. The assembled catcher and charge plate are then bonded in the fixture.

14 Claims, 5 Drawing Sheets

METHOD OF FABRICATING A CATCHER/CHARGE PLATE ASSEMBLY

TECHNICAL FIELD

The present invention relates to continuous ink jet printers and, more particularly, to improved construction for the charge plate and catcher assembly in such printers.

BACKGROUND ART

In continuous ink jet printing, electrically conductive ink is supplied under pressure to a manifold region that distributes the ink to a plurality of orifices, typically arranged in a linear array(s). The ink discharges from the orifices in filaments which break into droplet streams. Individual droplet streams are selectively charged in the region of the break off from the filaments and charge drops are deflected from their normal trajectories. The deflected drops may be caught and recirculated, and the undeflected drops allowed to proceed to a print medium.

Drops are charged by a charge plate having a plurality of charging electrodes along one edge, and a corresponding plurality of connecting leads along one surface. The edge of the charge plate having the charging electrodes is placed in close proximity to the break off point of the ink jet filaments, and charges applied to the leads to induce charges in the drops as they break off from the filaments. U.S. Pat. No. 4,560,991, issued Dec. 24, 1985, to W. Shutrum, describes one method of fabricating a charge plate. The charge plate taught by Shutrum is fabricated by electro-depositing the charging electrodes and leads on a flat sheet of etchable material, such as copper foil, to form a so-called "coupon." The coupon is bent in a jig at approximately a 90° angle. The leads are then bonded to a charge plate substrate, and the etchable material is removed.

In the prior art, a catcher body was formed by molding, as taught in U.S. Pat. No. 4,857,940 issued Aug. 15, 1989, to Rueping. The top surface of the catcher body was lapped to obtain requisite flatness, and the charge plate was bonded to the catcher body with oven cured epoxy. The area between the bottom of the charging electrodes and the front face of the catcher body was filled with epoxy and a fillet was formed under the charge electrodes using oven cured epoxy. The excess epoxy was then hand crafted under a microscope to remove the excess epoxy. A catcher plate was bonded to the bottom of the catcher body to form a catcher throat.

The tolerances on the charge plate/catcher assembly are critical. In the prior art, assembly steps subjected the part to several steps of heating and curing of epoxy which, due to thermal expansion and contraction of the parts, made the critical dimensions difficult to control. Furthermore, a resistor molded into the catcher body and employed as a heater during operation of the charge plate/catcher assembly to control condensation on the face of the catcher body and the charge electrodes proved difficult to control and produced unstable temperatures in the catcher body capable of distorting the catcher beyond its critical tolerances.

It is seen then that there exists a need for a catcher/charge plate assembly which can be assembled to a very high degree of tolerance.

SUMMARY OF THE INVENTION

This need is met by the catcher/charge plate assembly according to the present invention, wherein it is a primary object to provide an improved charge plate/catcher assembly which can be assembled to a very high degree of tolerance. It is a primary objective of the present invention to provide such an assembly which has been reduced to a single bonding step.

In accordance with one aspect of the present invention, a charge plate assembly fabrication comprises the steps of providing a catcher, including a catch pan, and providing a ceramic charge plate, the charge plate having an electrode face. The charge plate electrode face is prelapped to a uniform negative angle before assembling the charge plate and the catcher in a fixture. The assembled catcher/charge plate assembly is then bonded in the fixture.

Accordingly, it is an object of the present invention to provide a catcher/charge plate assembly which has been reduced to a single bonding step. This provides the advantage of minimizing thermal stresses on the charge plate, thereby maintaining critical tolerances and reducing the assembly time of the catcher/charge plate assembly.

Other objects and advantages of the invention will be apparent from the following description, the accompanying drawings and the appended claims.

DETAILED DESCRIPTION OF THE PREFERRED EMBODIMENTS

Figure 1:
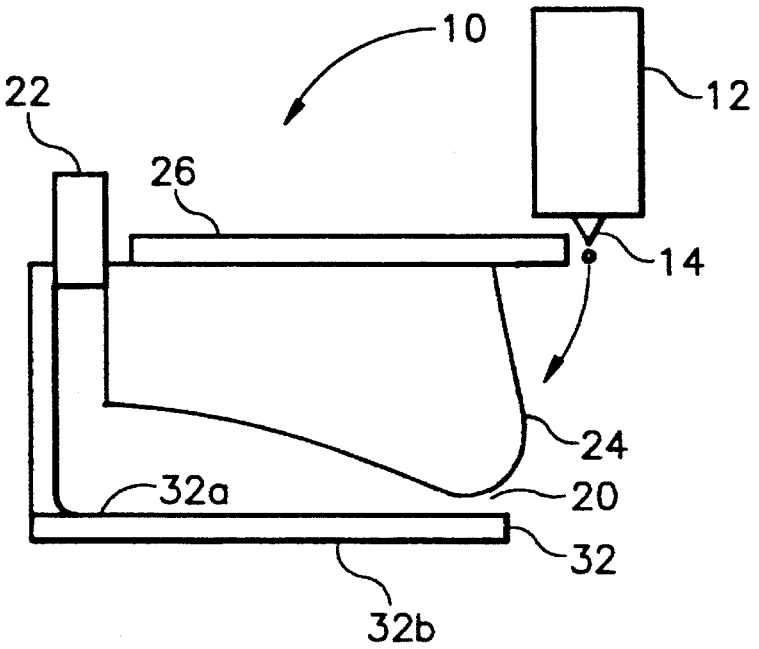
FIG. 1 is a schematic side view of an ink jet print head according to the present invention.

Referring to the drawings, in FIG. 1 a schematic side view of an ink jet print head according to the present invention is shown. The print head, generally designated 10, includes a resonator assembly 12 having an ink manifold and orifice plate (not shown) for generating filaments of ink 14. The resonator 12 stimulates the filaments 14 to break off in droplets in the region of a charging electrode on a charge plate/catcher assembly generally designated 16. Drops of ink are selectively charged by the charging electrodes and deflected onto a catcher face 18 and into a catcher throat 20. Uncharged drops proceed undeflected to a print medium (not shown). Collected ink is withdrawn through a catcher tube 22 and is recirculated in the ink jet printer.

Figure 2:
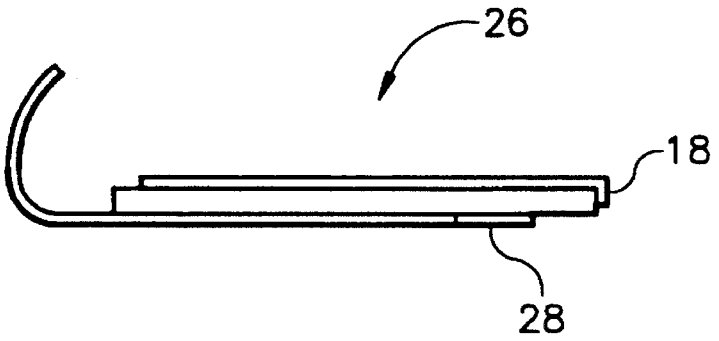
FIG. 2 is a schematic side view of an electrode coupon employed in the charge plate/catcher assembly portion of FIG. 1.

In FIG. 2, a flex circuit heater 28 may be attached to a ceramic charge plate 26 using pressure sensitive adhesives. The heater 28 is used to condense moisture during the cleaning process of the leads and is advantageous to use because it is very quick and easy to manufacture.

Figure 3:
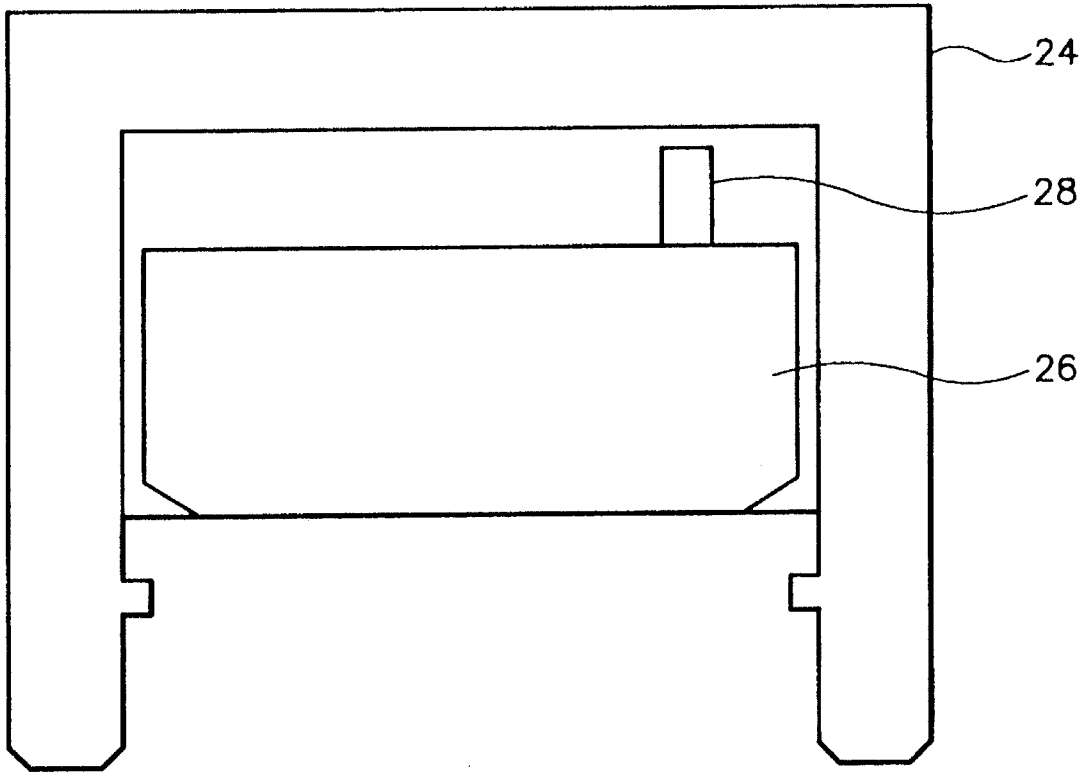
FIG. 3 is a top view of the charge plate/catcher assembly of FIG. 2.

A top partial view of the charge plate/catcher assembly 16 is shown in FIG. 3. The catcher/charge plate assembly 16 comprises a catcher 24, the charge plate 26, and a catch pan 32. The catcher body 24 is constructed by a machining process, and is preferably stainless steel. A top surface 30, in FIG. 5, of the catcher body 24 is machined flat to a tolerance of 0.002 inches, thereby enabling the charge plate 26 of FIG. 2 to be attached directly to the top of the catcher body 24 with no further machining of the catcher body being necessary.

Figure 4:
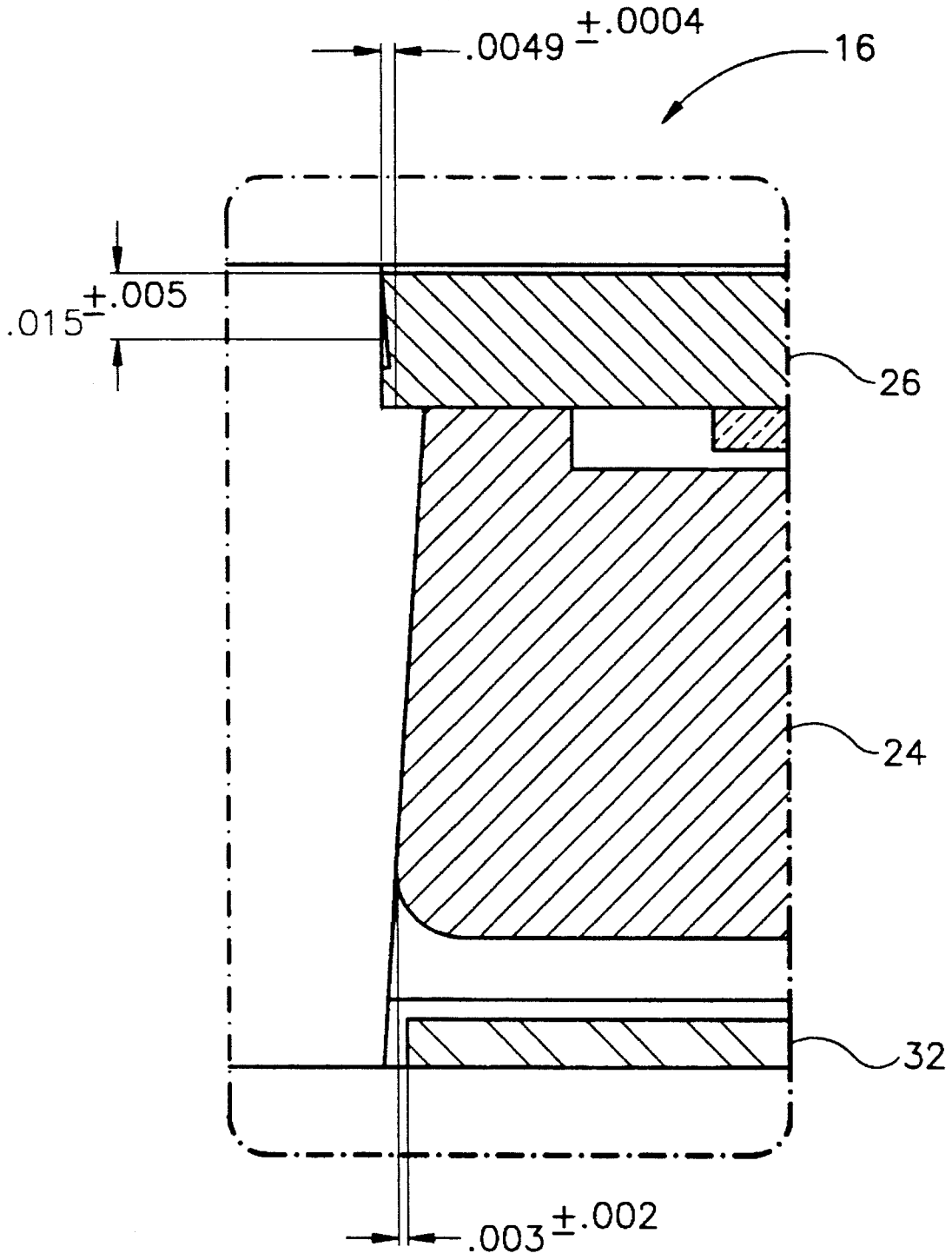
FIG. 4 is a cross-sectional view of the charge plate/catcher assembly of FIG. 2.

A section view of the assembled charge plate/catcher assembly 16 is shown in FIG. 4. The catch pan 32 is bonded to the bottom of the catcher 24, defining the catcher throat 20. In a preferred embodiment, the catch pan 32 is grit blasted on both sides to maintain flatness and achieve improved adhesion to the catcher 24. First, the catch pan is grit blasted on a top surface 32*a* to improve adhesion between the catch pan 32 and the catcher 24. However, the grit blasting causes surface stress on the catch pan 32, which results in bowing of the catch pan 32. Hence, the catch pan 32 is then grit blasted on a bottom surface 32*b* to cause the catch pan to bow back into a flat shape. The catch pan 32 and the catcher 24 preferably have like coefficients of thermal expansion to maintain the catcher flatness. The catcher face 18 on the front of the catcher body 24 is formed flat to within 0.0002 inches, therefore requiring no further machining.

Figure 6A:
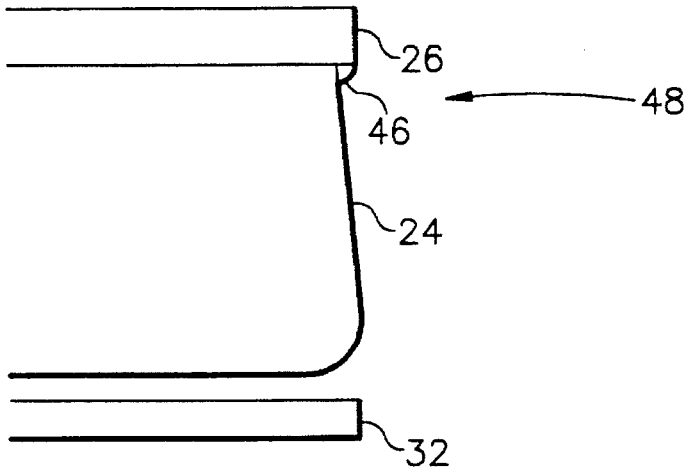
FIGS. 6A and 6B illustrate an epoxy fillet technique of the present invention.
Figure 6B:
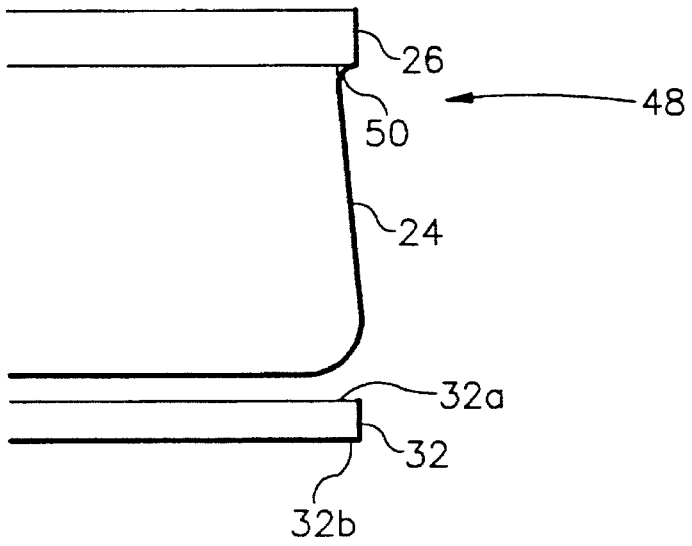

In a preferred embodiment, the profile of the catcher face, best illustrated in FIGS. 6A and 6B, is manufactured with a machine utilizing a ball end mill. The size of the ball end mill has a diameter of approximately 0.062 to 0.125 inches. In order to provide satisfactory surface finish, the machine has to step in 0.0005 increments. The profile of the catcher face preferably has a 3° angle and a 0.030 radii, which must be machined to within 0.0002 via a machine control program.

Figure 5:
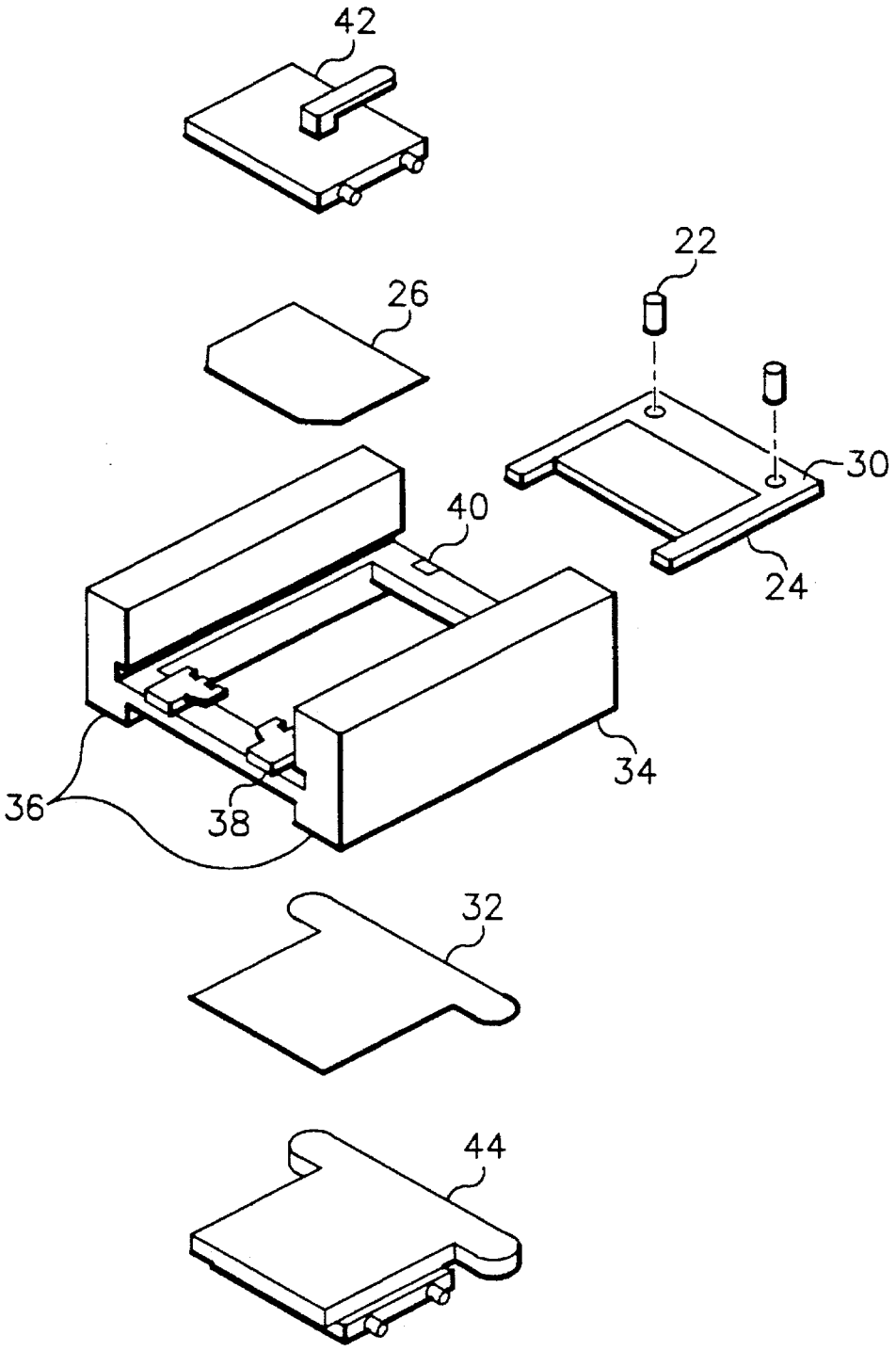
FIG. 5 is an exploded perspective view of the charge plate/catcher assembly and alignment fixture employed during assembly.

Turning now to FIG. 5, the charge plate/catcher assembly 16 is assembled in a fixture generally designated 34. The assembly fixture 34 includes a pair of sidewalls 36 and a backwall 38 defining a trough for receiving the parts of the catcher/charge plate assembly 16. A spring plunger 40 is provided for urging the catcher body 24 against backwall 38 of the fixture 34 during assembly. A first pressure plate 42 is provided for applying pressure to the charge plate/catcher assembly 16 during bonding. A second pressure plate 44 is provided for applying pressure to the catch pan 32 during bonding.

Continuing with FIG. 5 and referring now to FIGS. 6A and 6B, the charge plate 26, catcher 24, and catch pan 32 are illustrated for the purpose of describing the assembly of those components. Prior to the assembly process, the charge plate 26 is prelapped to a uniform negative angle, preferably approximately a 2° angle, to uniformly flatten the leads. After the prelapping step, the assembly process begins. First, epoxy is screened to a bottom surface of the charge plate 26 and a top surface of the catch pan 32. The charge plate 26 and the catch pan 32 are then placed, with the epoxy side of each facing toward the catcher 24, in the fixture 34. Excess epoxy 46 is allowed to squeeze out into a transition area 48, as shown in FIG. 6A. The transition area 48 denotes the area of transition between the charge plate 26 and the catcher 24. It is desirable to have a uniform curved transition area 48 which will deter the collection of ink in the area 48.

Continuing with the assembly process, the next step is to urge the charge plate 26 and catch pan 32 forward against the backwall 38 with any suitable urging means, such as spring-loaded screws. The excess epoxy 46 is then removed to form a substantially curved epoxy fillet 50, as shown in FIG. 6B. In a preferred embodiment, a solvent moist swab is smoothed along the excess epoxy 46 until all of the excess epoxy 46 is removed, leaving the desired fillet 50. The fixture 34 and assembly 16 are then heated, such as by placing the entire fixture 34 and assembly 16 in an oven, to bond or cure the epoxy. In a preferred embodiment, the epoxy bond is cured for approximately two hours at a temperature of 150° F., resulting in a catcher/charge plate assembly which has been reduced to a single bonding step.

After the assembly 16 is cured, the assembly 16 is then uniformly postlapped normal to the face leads substantially the same setback each time. The setback refers to the distance which the face leads of charge plate 26 are from the catcher 24 radius, as shown in FIG. 4. This distance is preferably approximately 0.0049±0.0004 inches.

Industrial Applicability and Advantages

The present invention is useful in the field of ink jet printing, and has the advantage of being able to produce a catcher/charge plate assembly at closer tolerances than attainable using prior art methods. Since all of the elements of the assembly are bonded in a single heating step, tolerances on the final assembly are more easily held. The present invention provides the further advantage of offering improved filleting techniques. The use of the epoxy fillet is advantageous in that it is clean and neat. Finally, the use of a stainless steel catcher minimizes distortion due to environmental changes, such as in temperature and humidity.

Having described the invention in detail and by reference to the preferred embodiment thereof, it will be apparent that other modifications and variations are possible without departing from the scope of the invention defined in the appended claims.

We claim:

1. A method of fabricating a catcher/charge plate assembly for an ink jet printer comprising the steps of:

a. providing a catcher, including a catch pan;

b. providing a ceramic charge plate, the charge plate having an electrode face;

c. prelapping the charge plate electrode face to a uniform negative angle;

d. assembling the charge plate and the catcher in a fixture; and e. bonding the assembled catcher and charge plate in the fixture.

2. A method of fabricating a catcher/charge plate assembly as claimed in claim 1 wherein the uniform negative angle is less than perpendicular to a top surface of the electrode face.

3. A method of fabricating a catcher/charge plate assembly as claimed in claim 1 further comprising the step of attaching a heater means to a side of the ceramic charge plate.

4. A method of fabricating a catcher/charge plate assembly as claimed in claim 3 further comprising the step of screening epoxy over the ceramic charge plate, the heater means, and the catcher.

5. A method of fabricating a catcher/charge plate assembly as claimed in claim 4 further comprising the step of removing excess epoxy.

6. A method of fabricating a catcher/charge plate assembly as claimed in claim 5 wherein the step of removing excess epoxy comprises the steps of:

a. allowing excess epoxy to collect in a transition area between the charge plate and the catcher;

b. using a removal means to remove the excess epoxy; and c. creating a substantially curved fillet in the transition area.

7. A method of fabricating a catcher/charge plate assembly as claimed in claim 6 wherein the removal means comprises a solvent moist swab.

8. A method of fabricating a catcher/charge plate assembly as claimed in claim 7 wherein the step of creating a substantially curved fillet in the transition area comprises the step of smoothing away excess epoxy with the solvent moist swab.

9. A method of fabricating a catcher/charge plate assembly as claimed in claim 1 wherein the step of bonding comprises the step of bonding at a low temperature.

10. A method of fabricating a catcher/charge plate assembly as claimed in claim 9 wherein the low temperature is in the range of 100° F. to 150° F.

11. A method of fabricating a catcher/charge plate assembly as claimed in claim 9 wherein the step of bonding comprises the step of using a catcher and a catch pan whose materials have approximately equal coefficients of expansion.

12. A method of fabricating a catcher/charge plate assembly as claimed in claim 1 further comprising the step of grit blasting a top surface of the catch pan.

13. A method of fabricating a catcher/charge plate assembly as claimed in claim 1 further comprising the step of grit blasting a bottom surface of the catch pan.

14. A method of fabricating a catcher/charge plate assembly as claimed in claim 1 further comprising the step of postlapping the charge plate electrode face.

* * * * *